US006169850B1

(12) United States Patent
Menassa

(10) Patent No.: US 6,169,850 B1
(45) Date of Patent: Jan. 2, 2001

(54) AIR HEATING DEVICE

(76) Inventor: Chérif Menassa, 39, Shédiac, Kirkland, P.Q. (CA), H9J 2J8

( * ) Notice: Under 35 U.S.C. 154(b), the term of this patent shall be extended for 0 days.

(21) Appl. No.: 09/428,450

(22) Filed: Oct. 28, 1999

Related U.S. Application Data

(63) Continuation-in-part of application No. 09/028,589, filed on Feb. 24, 1998.

(51) Int. Cl.[7] ..... F24D 5/10
(52) U.S. Cl. ..... 392/350; 392/476
(58) Field of Search ..... 392/350, 365, 392/347, 376, 476; 219/532, 505; 165/217; 118/667; 374/41; 73/204.26; 236/38, 44 R

(56) References Cited

U.S. PATENT DOCUMENTS

| | | | | |
|---|---|---|---|---|
| 1,946,262 | * | 2/1934 | Adams | 392/476 |
| 3,553,431 | | 1/1971 | Petersen . | |
| 3,560,710 | | 2/1971 | Fuellemann . | |
| 3,594,546 | | 7/1971 | Smillie et al. . | |
| 3,641,312 | | 2/1972 | Ammerman et al. . | |
| 3,674,203 | * | 7/1972 | McGrath | 236/38 |
| 3,737,622 | | 6/1973 | Hallgreen . | |
| 4,304,127 | | 12/1981 | Feller . | |
| 4,523,081 | | 6/1985 | Geib, Sr. et al. . | |
| 4,595,139 | * | 6/1986 | Levine | 236/44 R |
| 4,641,013 | | 2/1987 | Dunnigan et al. . | |
| 4,642,441 | | 2/1987 | Kenyon . | |
| 4,886,110 | | 12/1989 | Jackson . | |
| 4,966,037 | | 10/1990 | Sumner et al. . | |
| 5,050,533 | | 9/1991 | Zaber . | |
| 5,111,527 | | 5/1992 | Arold et al. . | |
| 5,214,740 | | 5/1993 | Carroll . | |
| 5,652,826 | | 7/1997 | Mills . | |
| 5,805,767 | | 9/1998 | Jouas et al. . | |

* cited by examiner

*Primary Examiner*—Teresa Walberg
*Assistant Examiner*—Quang Van

(57) ABSTRACT

This air heating device especially suited for low pressure air comprises an air duct in which an electric heating coil is located together with a thermistor which is part of an electronic thermostat to control the electric heating coil. The thermistor bead is so located as to see the heating coil and be exposed to the radiant heat of the latter. The thermistor is used as an airflow sensor so that the heating coil will gradually be decreasing its heating capability to eventually shut off according to the air velocity and temperature entering the duct; heating will be restored automatically once the airflow in the duct assembly has sufficiently cooled down the thermistor, therefore the thermistor acts as an airflow sensor to modulate the heating capacity according to the quantity of air flowing through the heating device to prevent overheating of the coil and consequently the activation of a thermal cut-out safety feature. The heating device can be used either in a fresh air intake for a central air furnace or for a heat pump or simply for baseboard heating with a duct fan, or as a unit incorporated into a larger forced air heating network system.

11 Claims, 5 Drawing Sheets

AIR HEATING DEVICE

CROSS REFERENCE TO RELATED APPLICATION

This application is a Continuation-In-Part of U.S. patent application Ser. No. 09/028,589 of C. Menassa filed on Feb. 24, 1998.

FIELD OF THE INVENTION

The present invention relates to an electric air heating device and, more particularly, of the type wherein an electric heating element is located within a enclosure wherein air is circulated through.

BACKGROUND OF THE INVENTION

For a central air furnace or for a heat pump, or for baseboard heating, especially suited for low pressure air, wherein fresh air from the outside is circulated within a duct by the fan of the furnace or a fan located in the duct for the baseboard heating, it is known to provide a preheated fresh air intake that is heated by an electric heating coil located within the duct. The same type of electric air heater is used in air heating home systems wherein the duct unit is used as a zone heater being incorporated in the air duct network re-circulating the air from a central air furnace. In all of these applications, it is essential to provide a thermal cut-out connected to the power line feeding the electric coil in order to prevent overheating of the duct with consequent fire hazard. This overheating is usually produced by partial or complete clogging of the duct whereby airflow through the duct is partially or totally obstructed. These thermal cut-outs are of the bimetal type and may be provided with an automatic reset or a manual reset.

The temperature differential between the on and off position or state of the automatic reset thermal cut-out is very high, for instance of the order of 30° F. to 40° F. (17° C. to 22° C.) and, therefore, the electric heater may be out of commission for an excessively long time before it is reset which may be great inconvenience in the winter time at low outside temperature, for instance, when the unit is used in a fresh air intake.

In the manual reset type of thermal cut-out, an attendant must locate the defective electric air heater unit and reset heating. This also may take a long time.

In order to obviate this disadvantage, an air pressure detector is often used in such duct type electric air heaters. Such an air pressure detector detects the change of air pressure within the duct depending on the amount of air flowing therethrough. These air pressure detectors or sensors comprise a diaphragm and, in order to be sufficiently sensitive, this diaphragm must have a large diameter. Such devices are expensive, cumbersome and are also not always efficient in case a complete obstruction of the duct would occur since they would detect an air pressure inside the duct while no air is really flowing to cool down the heating coil; this could cause an overheating of the system.

OBJECTS OF THE INVENTION

Therefore, it is the general object of the present invention to provide a duct type electric air heater device which obviates the above-noted disadvantages being provided with a novel type air flow sensor that is much more precise and less cumbersome than known air pressure detectors.

Another object of the present invention is to provide a duct type electric air heater of the character described provided with simple means to gradually decrease, up to a full cut-out if required, the electric source output upon detecting even a slight obstruction of the duct.

SUMMARY OF THE INVENTION

The electric air heating device, especially suited for low pressure air and used for heating air flowing within a duct of an air temperature control network for a house or a building, comprises an enclosure with air inlet and outlet through which variable low pressure air flow is circulated, an electric heating element mounted within said enclosure inbetween said inlet and outlet and to be exposed to and to heat the air circulated therethrough, said heating element emitting radiant heat inversely to the air flow circulating through said enclosure, a power line connected to an alternating current source and to said element, an electronic switching means series connected in said power line, a first thermistor located in said enclosure adjacent and along said heating element and exposed to the radiant heat emitted by said heating element, and a first thermistor dependent control circuit means for controlling said electronic switching means to cause the latter to change between a conducting and a non-conducting state in accordance with the radiant heat emitted by said element, said radiant heat being decreased with respect to the increasing velocity of the air flowing through said enclosure and with decreasing temperature of the air entering said enclosure, said first control circuit means includes a calibrating means to adjust a minimum and a maximum temperatures of said first thermistor between which said electronic switching means gradually changes from a conducting to a non-conducting state, resulting to a permanent heating condition of said heating element and a permanent non-heating condition respectively, said first control circuit means also includes a first pulse generating means and a first pulse duration modulating means to send a first signal to modulate the number of state changes and duration of the conducting state of said electronic switching means during each cycle of said alternating current source, between both said permanent heating and non-heating conditions; thereby providing a gradual heating of said heating element controlled by said first thermistor that acts as an air flow sensor to allow for maximal heating capability of said heating element depending on said air flow circulating through said enclosure.

Preferably, the device further includes an opto-isolator means between the power line and the first control circuit means.

Preferably, the electronic switching means is a triac, the gate of which is connected to the output of the opto-isolator means.

Preferably, the device further includes a bimetallic thermal cut-out switch series connected in said power line and located within said enclosure to be exposed to the air circulating within said enclosure and switching off said power line upon sensing a high air temperature $T_H$ in said enclosure and wherein said high air temperature $T_H$ is set such that it is reached after said first thermistor reaches its own maximum temperature.

Preferably, the heating element is either an opencoil or a tubular coil which extends longitudinally within said enclosure from said air inlet to said air outlet and said first thermistor is a thermistor bead disposed in the peripheral zone of said enclosure and approximately at mid-length of said coil and sees said coil.

Preferably, the device further includes a second thermistor which is either located about the center of said air outlet and downstream from said coil or in an enclosed space wherein the air circulated through said enclosure is discharged, a second thermistor dependent control circuit means including a second pulse generating means and a second pulse duration modulating means, said second control circuit means connected with said first control circuit means at the input of said opto-isolator means, said second thermistor and second control circuit means sending a second signal to said electronic switch to modulate the number of state changes and duration of the conducting state of said electronic switching means during each cycle of said alternating current source so as to proportionally maintain a preset air temperature at said second thermistor location, downstream of said coil or in said enclosed space.

In the device of the invention, the second signal is always overridden by the first signal.

BRIEF DESCRIPTION OF THE DRAWINGS

In the annexed drawings, like reference characters indicate like elements throughout.

DETAILED DESCRIPTION OF THE PREFERRED EMBODIMENTS

Figure 1:
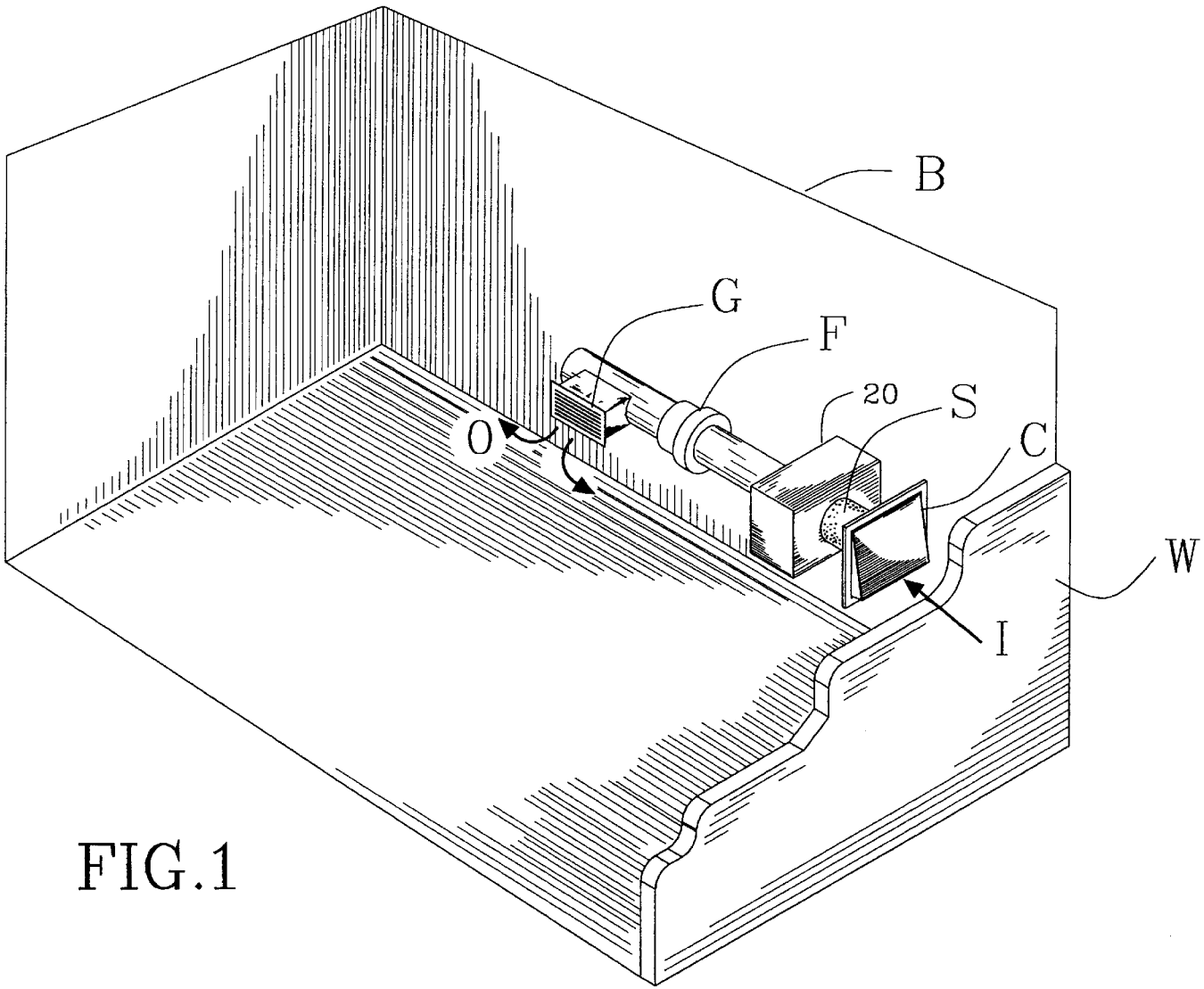
FIG. 1 is a broken schematic perspective view of an embodiment of an air heating device in accordance with the present invention being used in preheating fresh air supplied to a building.

Referring to FIG. 1, there is shown an embodiment of the air heating device 20, especially suited for low pressure air, in accordance with the present invention being used in preheating fresh air supplied to a building B. The fresh air I from outside gets sucked into the building B under the action of a fan F present in the duct network. Before getting into an enclosed space of the building B, the air I enters through a wall cap C generally located on an external wall W and is circulated to reach the air heating device 20 where it is warmed up to a preset temperature, when required. At this point, the warmed air O is discharged into the enclosed space through the discharge grille G. In such a duct network, the fan F is preferably located downstream of the air heating device 20 in order to prevent any long term damage or reduced efficiency due to condensation of cold air. This is especially true in regions where the external air I can sometimes be fairly cold, below 32° F. (0° C.). For these regions, the first portion of the air duct between the wall cap C and the air heating device 20 is covered with thermal insulation material S to prevent any water condensation around that first portion which could be really inconvenient and cause material damages.

Figure 2:
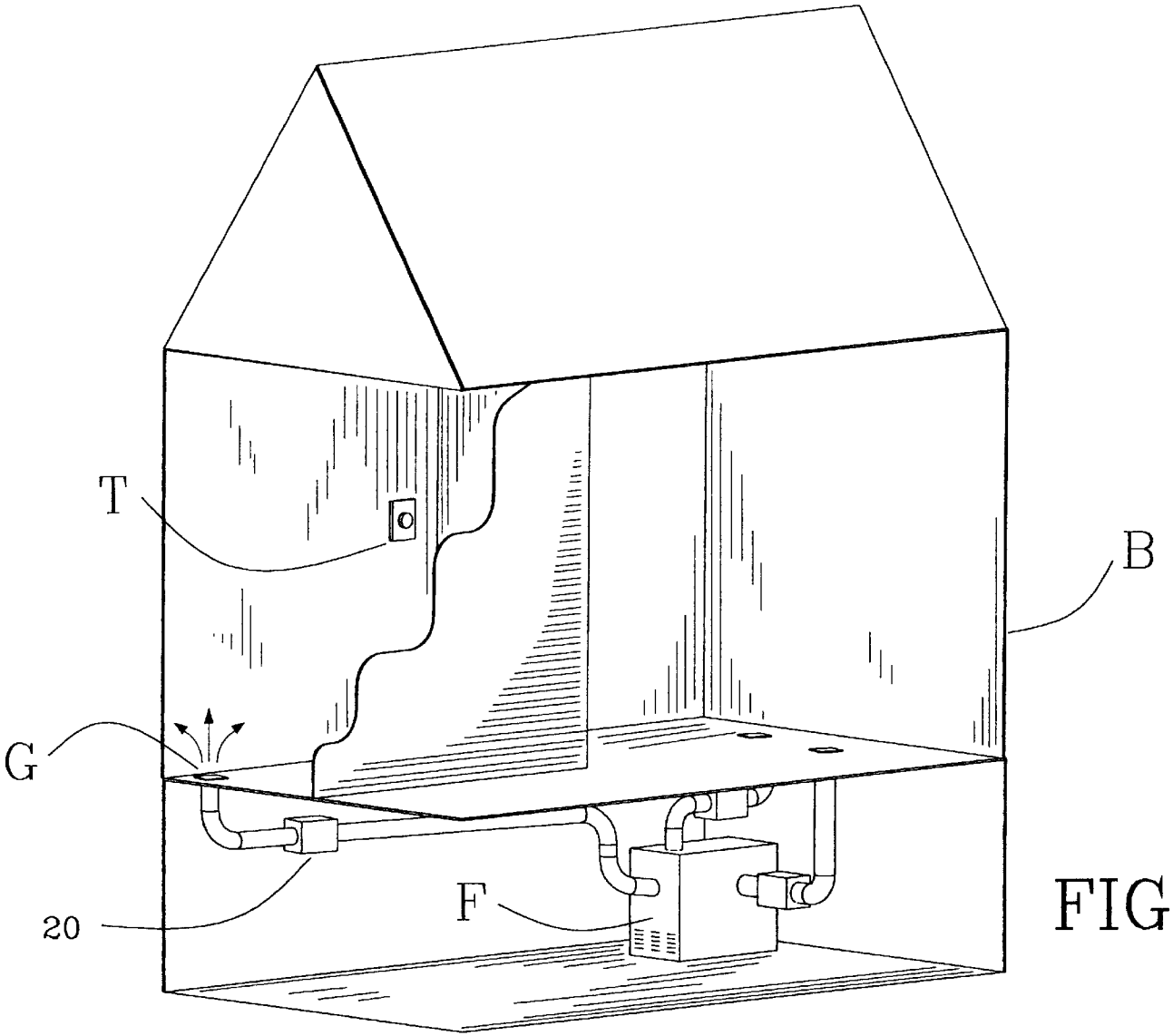
FIG. 2 is a broken schematic perspective view of an embodiment of an air heating device in accordance with the present invention being used in zone type of heating inside a building.

FIG. 2 shows another embodiment of the air heating device 20 being used within a temperature control network including a furnace with a circulating fan F of a house or a building B to warm the air going to a specific zone Z. The desired temperature for the zone Z is selected via an electronic thermostat T located inside the zone Z and constitutes the preset temperature for the air heating device 20.

Similarly, the air heating device 20 is perfectly suited to be combined to variable air volume (VAV) systems, widely used in temperature control networks in commercial buildings, that supply relatively cold air.

Figure 3:
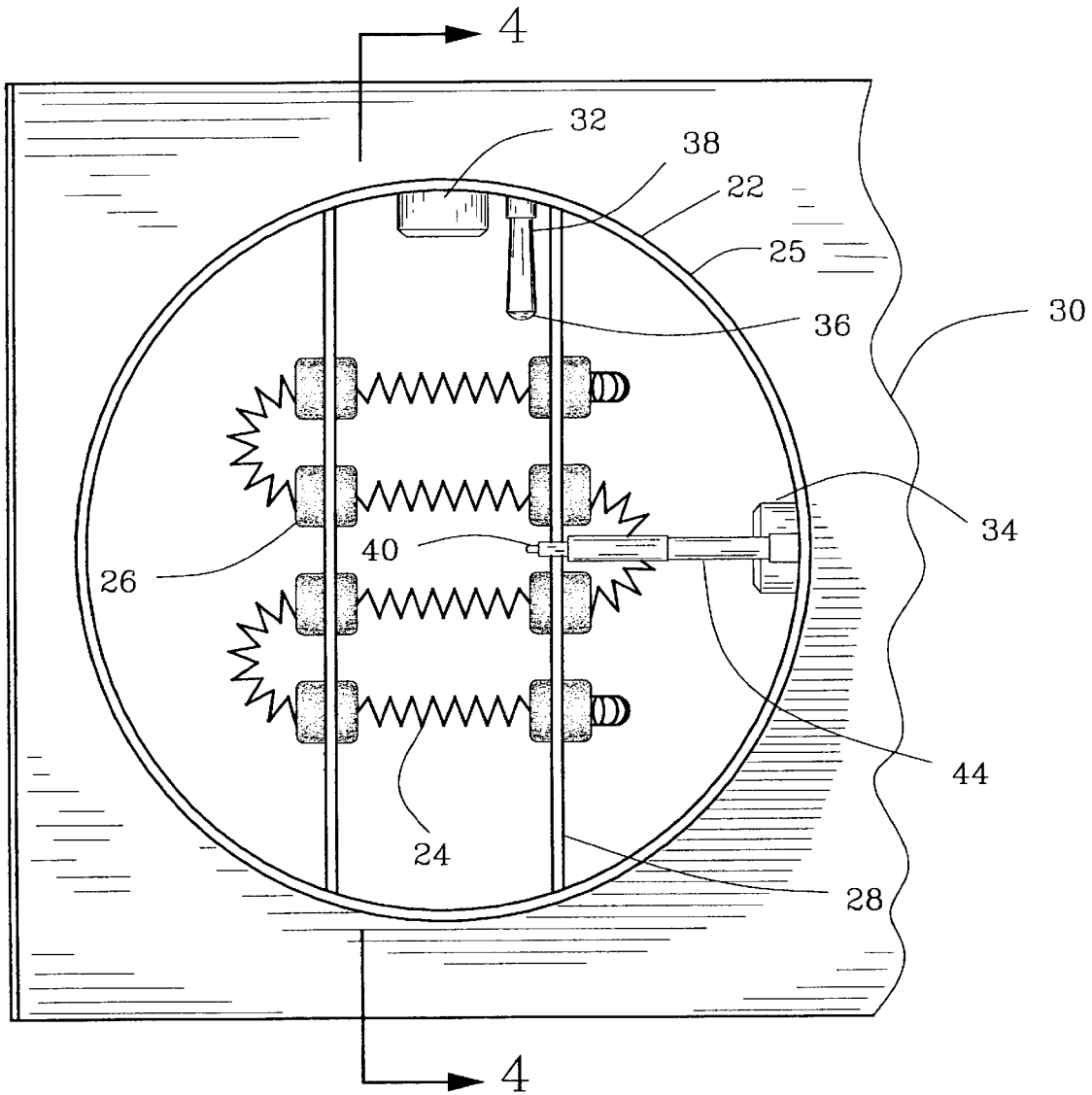
FIG. 3 is a front elevation of an embodiment of an air heating device in accordance with the present invention showing the duct type electric air heating system with a round collar being adapted for receiving with a standard air heating duct.

Referring to FIG. 3, there is shown an embodiment of the air heating device 20 with an enclosure, preferably a standard duct 22, for instance of 6 to 8 inches in diameter, having an air inlet 23 and an air outlet 25 with preferably round collars adapted to be connected in a standard duct network as used in air heating or cooling network systems in residential, commercial and industrial buildings.

An electric heating coil 24, for instance an opencoil made out of a nickel-chrome resistance wire, is supported by insulators 26 and mounting sheet metal strips 28 within duct 22. The heating coil 24 extends through a certain length of duct 22, for instance for about 10 inches. The duct 22 in the area of the heating coil 24 is enclosed in a casing 30 in which are located the electronic and electric components of the circuit controlling and feeding the electric heating coil 24. Alternatively, the electric heating coil could be a tubular type of coil.

Referring again to FIG. 3, it is seen that inside duct 22 is secured an automatic reset thermal cut-out 32 which is of known construction. This cut-out is of the bimetal type and are directly series-connected in the power line for the heating coil 24 to serve as a safety feature against overheating and possible fire hazard that would occur if the air heating device happens to fail in a closed circuit condition.

Additionally, there is usually provided a manual reset thermal cut-out indicated at 34 secured to the duct 22 and which serves as an additional safety feature to prevent the duct 22 and the casing 30 from overheating. This manual reset cut-out 34 is also series-connected in the power circuit for the heating coil 24.

Figure 4:
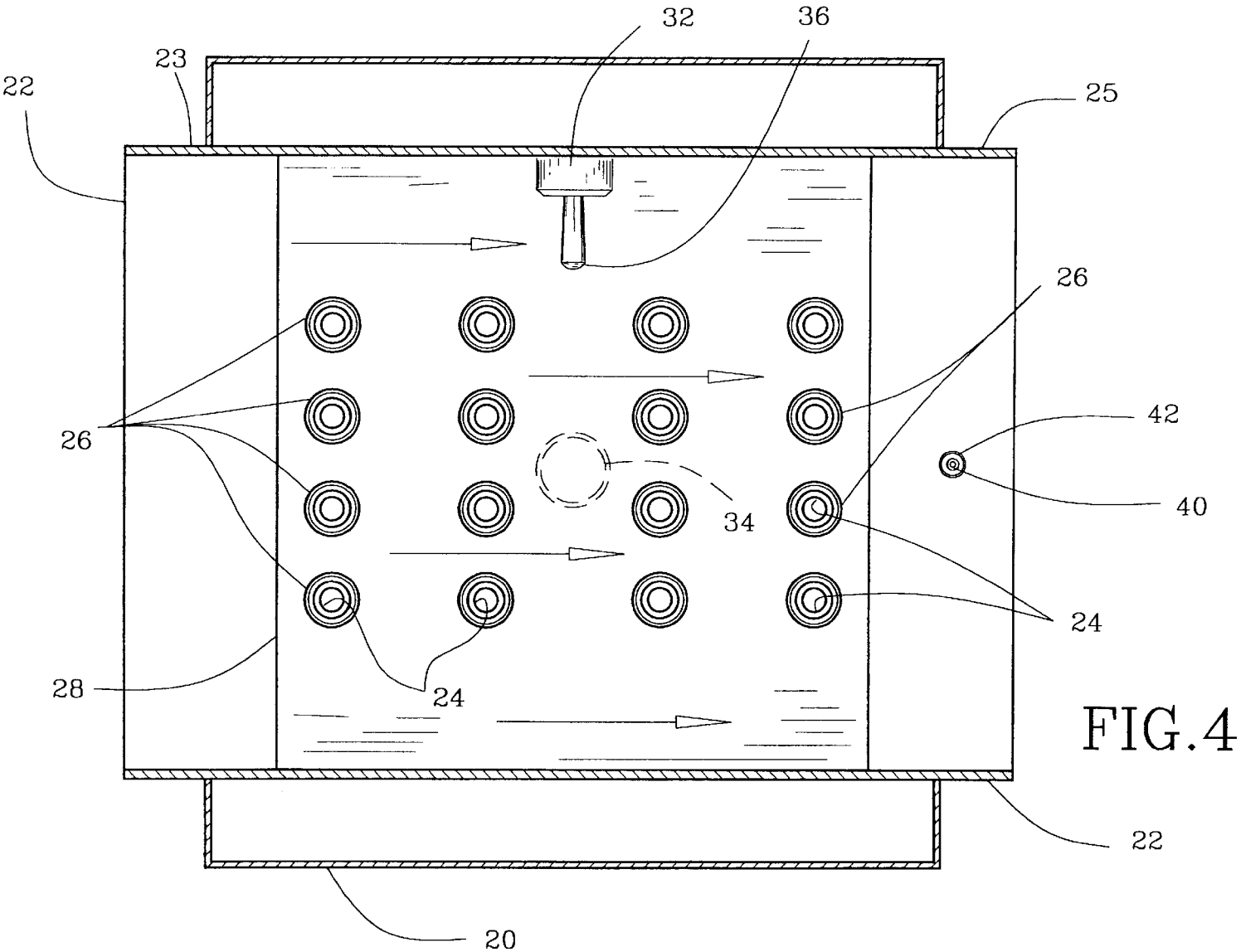
FIG. 4 is a section view taken along line 4—4 of FIG. 3.

FIGS. 3 and 4 also show a thermistor bead 36 mounted on a support 38 fixed to the duct 22 and exposed within the duct 22 and in direct view of the coil 24. This thermistor bead 36 is located outwardly of and approximately mid-length of the heating coil 24 within the duct 22, and near the thermal cut-out 32. Bead 36 is located in the peripheral zone of duct 22.

Another thermistor bead 40 is supported by a support 42 secured to the duct 22, the second thermistor bead 40 is located in the center region of the air outlet 25 and downstream from the electric heating coil 24 (see FIG. 4).

As shown in FIG. 4, the air is circulated within the duct 22 from the air inlet 23 to the outlet 25 by any type of fan or blower.

It will be understood that the radiant heat emitted by coil 24 decreases with an increase in the velocity of the air flowing through the duct 22 and also decreases with the decrease of the air temperature of the air entering through the inlet 23. Therefore, using a thermistor bead 36 exposed to the radiant heat of the coil 24 enables to obtain a precise measurement of the air temperature inside the air heating device 20 which is pre-calibrated with the velocity and the temperature of the air flowing through the duct 22.

Figure 5:
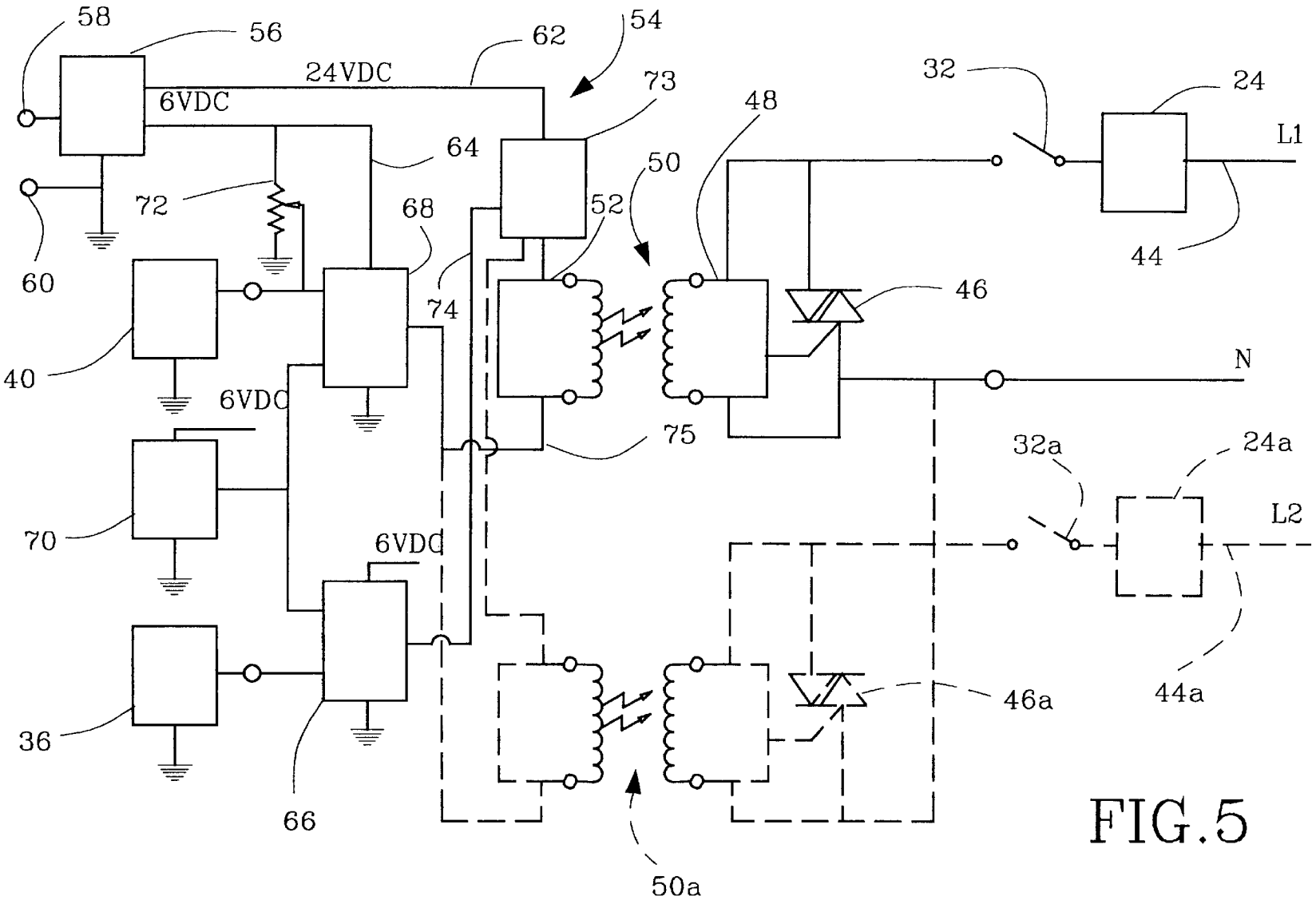
FIG. 5 is a schematic diagram of the electric and electronic circuit for the heating device.

Referring to FIG. 5, it is seen that the electric heating coil 24 is connected in a power line 44 connected at L1 and L2 to an alternating current power source and, that thermal cut-out 32 is series-connected to the heating coil 24. The power line or circuit 44 includes a triac 46, the gate of which is controlled by the output side 48 of an opto-isolator 50, the input side 52 of which is connected in a control circuit generally shown at 54 and incorporating both thermistor beads 36 and 40. As shown, a second electric heating coil 24*a* could be provided within duct 22 and controlled by the same control circuit 54 operating through a second opto-isolator 50*a*, a parallel power line circuit 44*a* as indicated in dotted lines in FIG. 5.

The control circuit 54 for controlling the operation of the triac 46 includes a transformer rectifier 56 connected to a 24-volt alternating current input 58 and return 60. A 24-volt direct current line 62 connects the output of transformer rectifier 56 to the input of a gradual cut-out control circuit 73. The output of the gradual cut-out control circuit 73 connects to the input 52 of the opto-isolator 50. Transformer rectifier 56 has a 6-volt DC output connected to line 64 which feeds a first pulse width modulation controller and driver 66 associated with thermistor 36 and a second pulse width modulation controller and driver 68 associated with thermistor 40. Pulse width modulation and driver 66 associated with thermistor 36 feeds, via line 74, the gradual cut-out control circuit 73 that controls the 24-volt line 62 energizing the triac 46 via the opto-isolator 50.

A saw-tooth generator 70 is fed with a 6-volt DC current from the output of transformer rectifier 56 and is connected to both pulse width modulation controllers and drivers 66 and 68.

A potentiometer 72 is connected between the 6-volt DC output of transformer rectifier 56 and the line connecting thermistor 40 to second pulse width modulation controller and driver 68, and serves to adjust the set point of the operation of triac 46 in relation with the voltage signal emitted by thermistor 40. The potentiometer 72 is for instance a manual thermostat, preferably electronic, used to select a desired set point temperature (pre-set temperature of the heating device 20) of the air of the duct 22 flowing downstream of the air heating coil 24.

The saw-tooth generator 70 and pulse width modulators and drivers 66 and 68 of the control circuit 54 serve to send a signal to the gate of the triac 46 through the opto-isolator 50 so as to modulate the number of state changes and duration of the conducting state of the triac 46 during each cycle of the alternating current source as provided by the power line 44. The fact that the thermistor 36 is exposed to the radiant heat of the electric coil 24 and operates an electronic thermostat within the control circuit 54 and feeds the triac 46 through the opto-isolator 50 and gradual cut-out control circuit 73 results in a relatively accurate temperature measurement for controlling the coil depending on the velocity and the temperature of the air entering the duct 22 by means of a temperature sensitive element, namely thermistor 36.

In practice, thermistor 36, being affected by the radiant heat of the heating coil 24 because of its location adjacent and along the heating coil 24, will start to gradually decrease the heating capacity of the latter at a minimum temperature below which it is safe for the heating coil 24 to fully operate (permanent heating condition) at 100% of its capacity, up to a maximum temperature at and above which the power line 44 is completely cut-out (permanent non-heating condition) since the heating coil 24 would start to overheat and eventually make the automatic reset thermal cut-out 32 to cut off the power line 44. In between these two minimum and maximum temperatures, the thermistor 36, via its pulse width modulation controller and driver 66 and the gradual cut-out circuit 73, will modulate the heating capacity of the heating coil 24 to match the air flow available going through the duct 22 and which varies both in velocity and temperature. The second thermistor 40 serves to measure the air temperature within the duct 22 and operates the triac 46, via line 75, so as to maintain the output air temperature within a narrow range of about 2° F. (1° C.) in which its associated pulse width modulation controller and driver 68 requires heating, a preferred example being a cut-off at 70° F. (20.5° C.) and a reset at 68° F. (19.5° C.).

It is clear that the first thermistor 36 and its operating circuit overrides the operation of the second thermistor 40 and its operating circuit when a too low air velocity through duct 22 is detected; this condition will reduce the amount of energization of the heating coil 24 even under the action of the second thermistor 40 detecting too low air temperature within the air duct 22, downstream of the heating coil 24. The use of the first thermistor 36 would prevent, in case of slight obstruction of duct 22, the repeated activation of the thermal cut-out 32. In the case of an automatic reset thermal cut-out, the reset would occur at really low temperature causing long delays before re-heating of the coil 24 resulting in uncomfortable temperatures. In the case of manual reset thermal cut-out, the reset operation could further be long and difficult, because of heating system accessibility.

When the electric air heating device 20 incorporating duct 22, electric heating coil 24 and its operating circuit is used as a zone heating element in a house, as previously described and shown in FIG. 2, the second thermistor 40 will then be located in the room, the temperature of which is to be controlled instead of being located within duct 22 as shown in FIGS. 3 and 4 referring to embodiment of FIG. 1. In this case also, the first thermistor 36 acts as an airflow sensor within the duct 22, namely a sensor which detects the air temperature in proximity to the heating coil 24 based on the radiant heat from the coil 24 and the air velocity within the duct 22.

The gradual decrease of power fed to the heating coil 24 due to the action of the airflow sensor and first thermistor 36 allows for a constant heating, rather that an on/off situation, of the air flowing through the duct 22 whenever power is enabled by the action of the second thermistor 40 and its pulse width modulation controller and driver 68. This constant heating, even while decreasing, provides a better control of the air temperature downstream of the duct 22, therefore providing a better comfort for people in the room.

Particularly, when used in combination with VAV systems which are required to always provide a minimum air flow for ventilation, the air heating device 20 of the present invention will safely operate and modulate its heating capacity at this low air flow with minimum amount of energy required, since it is specifically at this minimum air flow condition that heating will be required. As opposed to conventional heaters that would require an increase of the air flow to operate, resulting in heating much more air and consuming more energy that what is actually required.

I claim:

1. An electric air heating device especially suited for low pressure air and used for heating air flowing within a duct of an air temperature control network for a house or a building, said device comprising an enclosure with air inlet and outlet through which variable low pressure air flow is circulated, an electric heating element mounted within said enclosure inbetween said inlet and outlet and to be exposed to and to heat the air circulated therethrough, said heating element emitting radiant heat inversely to the air flow circulating through said enclosure, a power line connected to an alternating current source and to said element, an electronic switching means series connected in said power line, a first thermistor located in said enclosure adjacent and along said heating element and exposed to the radiant heat emitted by said heating element, and a first thermistor dependent control circuit means for controlling said electronic switching means to cause the latter to change between a conducting and a non-conducting state in accordance with the radiant heat emitted by said element, said radiant heat being decreased with respect to the increasing velocity of the air flowing through said enclosure and with decreasing temperature of the air entering said enclosure, said first control circuit means includes a calibrating means to adjust a minimum and a maximum temperatures of said first thermistor between which said electronic switching means gradually changes from a conducting to a non-conducting state, resulting to a permanent heating condition of said heating element and a permanent non-heating condition respectively, said first control circuit means also includes a first pulse generating means and a first pulse duration modulating means to send a first signal to modulate the number of state changes and duration of the conducting state of said electronic switching means during each cycle of said alternating current source, between both said permanent heating and non-heating conditions; thereby providing a gradual heating of said heating element controlled by said first thermistor that acts as an air flow sensor to allow for maximal heating capability of said heating element depending on said air flow circulating through said enclosure.

2. An electric air heating device as defined in claim 1, further including opto-isolator means between said power line said first control circuit means.

3. An electric air heating device as defined in claim 2, wherein said electronic switching means is a triac, the gate of which is connected to the output of said opto-isolator means.

4. An electric air heating device as defined in claim 1, further including a bimetallic thermal cut-out switch series connected in said power line and located within said enclosure to be exposed to the air circulating within said enclosure and switching off said power line upon sensing a high air temperature $T_H$ in said enclosure and wherein said high air temperature $T_H$ is set such that it is reached after said first thermistor reaches its own maximum temperature.

5. An electric air heating device as defined in claim 3, wherein said heating element is an opencoil which extends longitudinally within said enclosure from said air inlet to said air outlet and said first thermistor is a thermistor bead disposed in the peripheral zone of said enclosure and approximately at mid-length of said opencoil and sees said opencoil.

6. An electric air heating device as defined in claim 5, further including a second thermistor located about the center of said air outlet and downstream from said opencoil, a second thermistor dependent control circuit means including a second pulse generating means and a second pulse duration modulating means, said second control circuit means connected with said first control circuit means at the input of said opto-isolator means, said second thermistor and second control circuit means sending a second signal to said electronic switch to modulate the number of state changes and duration of the conducting state of said electronic switching means during each cycle of said alternating current source so as to proportionally maintain a preset air temperature at said second thermistor location, downstream of said opencoil.

7. An electric air heating device as defined in claim 6, wherein said second signal is always overridden by said first signal, thereby preventing overheating of said heating element in case said air flow is obstructed from circulating through said enclosure.

8. An electric air heating device as defined in claim 5, further including a second thermistor located in an enclosed space wherein the air circulated through said enclosure is discharged, a second thermistor dependent control circuit means including a second pulse generating means and a second pulse duration modulating means, said second control circuit means connected with said first control circuit means at the input of said opto-isolator means, said second thermistor and second control circuit means sending a second signal to said electronic switch to modulate the number of state changes and duration of the conducting state of said electronic switching means during each cycle of said alternating current source so as to proportionally maintain a preset air temperature in said enclosed space.

9. An electric air heating device as defined in claim 8, wherein said second signal is always overridden by said first signal, thereby preventing overheating of said heating element in case said air flow is obstructed from circulating through said enclosure.

10. An electric air heating device as defined in claim 7, further including a bimetallic thermal cut-out switch series connected in said power line and located within said enclosure to be exposed to the air circulating within said enclosure and switching off said power line upon sensing a high air temperature $T_H$ in said enclosure and wherein said high air temperature $T_H$ is set such that it is reached after said first thermistor reaches its own maximum temperature.

11. An electric air heating device as defined in claim 9, further including a bimetallic thermal cut-out switch series connected in said power line and located within said enclosure to be exposed to the air circulating within said enclosure and switching off said power line upon sensing a high air temperature $T_H$ in said enclosure and wherein said high air temperature $T_H$ is set such that it is reached after said first thermistor reaches its own maximum temperature.

* * * * *